US007743815B2

(12) United States Patent
Clauss

(10) Patent No.: US 7,743,815 B2
(45) Date of Patent: Jun. 29, 2010

(54) SLATS FOR A SUN PROTECTION BLIND

(76) Inventor: Ulrich Clauss, Rauberweg 3, Bissingen (DE) 73266

( * ) Notice: Subject to any disclaimer, the term of this patent is extended or adjusted under 35 U.S.C. 154(b) by 419 days.

(21) Appl. No.: 11/662,464

(22) PCT Filed: Aug. 24, 2005

(86) PCT No.: PCT/EP2005/009113

§ 371 (c)(1),
(2), (4) Date: Jun. 5, 2007

(87) PCT Pub. No.: WO2006/027104

PCT Pub. Date: Mar. 16, 2006

(65) Prior Publication Data

US 2008/0087385 A1 Apr. 17, 2008

(30) Foreign Application Priority Data

Sep. 9, 2004 (DE) ..... 10 2004 043 573

(51) Int. Cl.
*E06B 9/165* (2006.01)

(52) U.S. Cl. ..... 160/133; 160/232; 160/235

(58) Field of Classification Search ..... 160/133, 160/232, 235, 236; 49/92.1
See application file for complete search history.

(56) References Cited

U.S. PATENT DOCUMENTS

| | | | | | |
|---|---|---|---|---|---|
| 880,701 | A | * | 3/1908 | Vance | 160/232 |
| 910,218 | A | * | 1/1909 | McCloud | 160/232 |
| 2,872,977 | A | * | 2/1959 | Pagliaccetti et al. | 160/220 |
| 4,042,005 | A | * | 8/1977 | Hammerstein | 160/220 |
| 4,343,340 | A | * | 8/1982 | Paule | 160/232 |
| 4,601,953 | A | * | 7/1986 | Haffer | 428/457 |
| 4,723,588 | A | * | 2/1988 | Ruppel | 160/236 |
| 5,204,147 | A | * | 4/1993 | Schneider | 428/35.8 |
| 5,210,924 | A | * | 5/1993 | Schneider | 29/469.5 |

FOREIGN PATENT DOCUMENTS

| | | | |
|---|---|---|---|
| FR | 1519724 | A | 4/1968 |
| GB | 2055935 | A | 3/1981 |

* cited by examiner

*Primary Examiner*—David Purol
(74) *Attorney, Agent, or Firm*—Leydig, Voit & Mayer, Ltd.

(57) ABSTRACT

The invention relates to roller blind slats having a profile which is shaped by flat sheet metal in a rolling step. A single-pieced roller blind body is associated with the roller blind slats. The roller blind body is formed with a slot on the underside thereof and a hooked strip is provided on the top edge thereof. The slot part is approximately 20% on the total surface of the roller blind slats.

17 Claims, 5 Drawing Sheets

SLATS FOR A SUN PROTECTION BLIND

BACKGROUND OF THE INVENTION

It is a familiar practice to also use roller curtains made from laths for sun protection. For this purpose, a user will let down the roller curtain a bit, so that the roller curtain casts an appropriate shadow. Relatively little light gets through the roller curtain itself. The ratio of slots to the overall surface is about 1.5%. As a result, the roller curtain generally cannot be let down entirely for sun protection purposes since the resulting darkness would be too deep.

Known roller curtains are made from individual laths with a bottom with an undercut channel and a hooked slat at the top. Extremely tiny slots, relative to the surface of the roller curtain, are situated in the area of the hooked slat. Thus, larger slots cannot be provided on the main body of the lath since it no longer would be possible to control the admission of light by rolling the roller curtain up or down.

Known laths have a roll shaped profile that is often packed with foam or provided with crosspieces running in the longitudinal direction of the lath in order to achieve the necessary strength.

BRIEF SUMMARY OF THE INVENTION

In view of the foregoing, a general object of the present invention is to create a new type of lath.

According to one aspect of the invention, a lath is provided which comprises a roll shaped part that does not require any further reinforcement measures on the inside.

According to another aspect of the invention, a lath is provided which affords good sun protection by preventing direct admission of sunlight when the sun is high in the sky while still allowing a lot of indirect light to get through the lath.

The roller shutter lath of the present invention can be made as a single piece from a strip of metal by a rolling shaping process. The roller shutter lath has a slat on its top side or upper edge that terminates in a channel that is open toward the bottom relative to the normal usage position. This arrangement produces a hook-like structure when viewed from the side that joins the roller shutter lath with another roller shutter lath located above it. The roller shutter lath also has a body on which the slat is formed as a single piece. At the lower side of the lath body there is a slot that is designed to receive the roller shutter lath located below. The roller shutter lath has a constant cross section across its length.

Since the new roller shutter lath can be made as a roll shaped part, any material suitable for rolling can be used including, for example, special steels, materials that otherwise would not be suitable for a roller shutter lath. Additionally, making the roller shutter lath as a roll shaped part allows the area of roller shutter body to be made relatively voluminous so that the final roller curtain has a large thickness and is therefore quite durable.

Because special steels can be used as the starting material, the roller shutter lath of the present invention is extremely weather-resistant and can be used in areas where aluminum would fail. For example, areas where a roller shutter lath of the present invention which is made of special steel materials can be used are the food industry or near sea water, even aboard ships or oceangoing containers. Moreover, because special steels can be used, the roller shutter lath of the present invention can be relatively resistant to forced entry, i.e., it takes a very long time to forcibly open the roller shutter curtain. According to one embodiment, the new roller shutter lath also can advantageously be made from coated aluminum.

Particularly favorable conditions result when the roller shutter lath has a continuous two-ply construction in terms of the cross section. With such a construction, one can employ a thin sheet metal for the rolling and forming while still producing a finished lath with a sufficient wall thickness.

Even though the roller shutter lath as a whole is has a two-ply construction, the individual segments could be single-ply or two-ply depending on the desired design. In particular, this can be the case for the slat, the area of the channel, the front side, the back side, or the bottom side.

For producing a particularly reliable locking together of the roller shutter laths and the facilitating mobility, the slot can be bounded by two parallel edges with at least one of the edges being curved upwards in the direction of the interior of the lath body. Such an arrangement produces a defined hanging edge for the channel on the hanging slat of the underneath lath. It can be particularly advantageous if the roller shutter lath has a double-ply construction in this area in order to easily support the weight of the entire roller curtain.

With the roller shutter lath of the present invention, the individual metal sheet layers can lie tightly and directly against each other except for in the root area of the slat. However, the layers can be separated from each other in the area of the front side so as to create a substantially enclosed chamber that can be packed with hard foam if so desired.

Advantages with respect to self-cleaning properties can be achieved if the lath is bounded on its front side by a surface that emerges from the slat, slants downward and then merges into a vertical surface. This slanting surface helps prevents areas where grime can build up.

If it is desired to allow light and/or air to still get in when the roller curtain is for the most part closed, elongated light slots can be located in the area of the slat between the roller shutter body and the molded-on channel. The height of these light slots can correspond to the height of the slat so that when the roller curtain is hanging down, the upper lath does not project into the light space profile of the light slot.

The new roller shutter lath has a lower side that extends horizontally or, if appropriate, slants upward from the front side in the direction of the slot. In this way, dripping water cannot get into the region of the slot and penetrate through the light slots.

The lath of the present invention can have a slat at its upper edge whose height is relatively large in comparison to the lath body. With such an arrangement, it is possible to form very large light/air slots in lath. The lath body can itself function as a sun canopy for the light slot of the lath located underneath. Thus, in an assembly of laths each of the laths can act like a small sun canopy that shades the light slot underneath from direct solar radiation.

A shutter curtain using the lath of the present invention divides the window surface into several light-transmitting strips situated one above another with each strip being formed by the respective light/air slot in the particular lath. Because of this division into strips, only relatively short projecting "sun canopies" are needed to accomplish the desired shading action for the light/air slots even when the sun is still relatively low in the sky. If there were no gap between the light-transmitting strips, a more protruding sun protection roof may be required.

With a division into spaced apart narrow strips, the spatial depth of the sun protection roof is reduced and can be accommodated within the thickness of a lath.

A curtain using the laths of the present invention lets through a great deal of indirect light while only shading incident sunlight. Accordingly, the shutter curtain can be let down entirely in the summer on a window outfitted with such a shutter curtain. The room with the window will remain bright, but the direct solar radiation will be blocked and unwanted heating of the room due to the direct solar radiation will be prevented.

The arrangement of the invention can operate in relatively narrow guide rails inside the room. In one embodiment, the thickness of the lath body viewed in the direction parallel to the normal line of the window surface is around 8-15 mm, while the height of the lath body varies between 8 and 15 mm (preferably, 10 mm).

Those skilled in the art will appreciate from the following figures and description of the illustrated embodiments that a number of changes can be made to the roller shutter lath based on the particular usage requirements or during the rolling and forming process. To present each individual modification would needlessly expand the description. The particular dimensions used will correspond to the particular requirements of a given application.

DETAILED DESCRIPTION OF THE INVENTION

Figure 1:
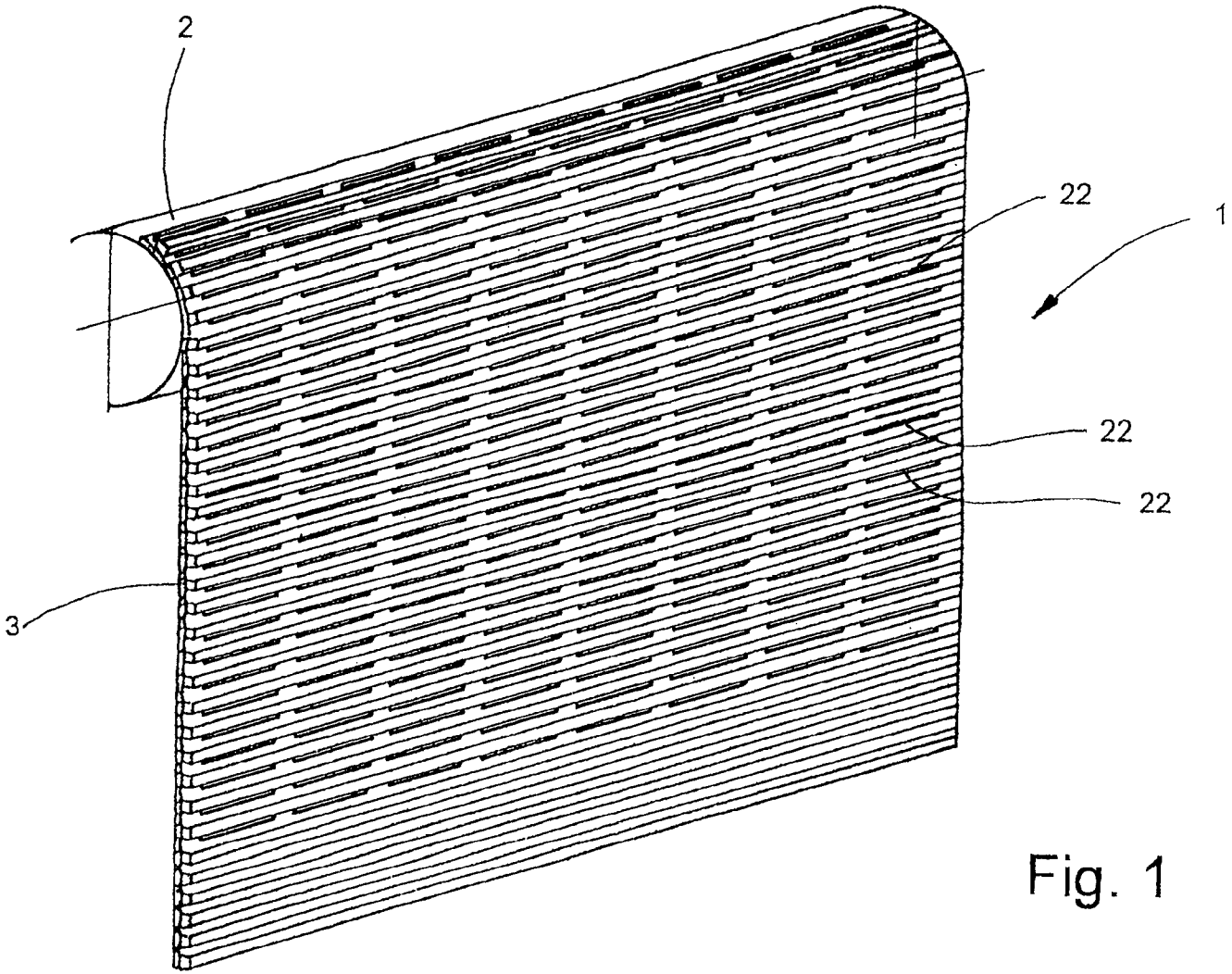
FIG. 1 is a highly schematic perspective view of an illustrative window or door shutter utilizing a shutter curtain including roller shutter laths according to the present invention.

Referring to FIG. 1 of the drawings, a roller shutter curtain 1 is shown such as is used for windows or roll down doors. A majority of the extent of the roller shutter curtain 1 is unwound from a winding shaft 2 to which the upper edge of the roller shutter curtain is fastened. The roller shutter curtain 1 includes a plurality of individual roller shutter laths 3, each of which can move to a limited extent about an axis that lies parallel to the axis of the winding shaft 2.

Figure 2:
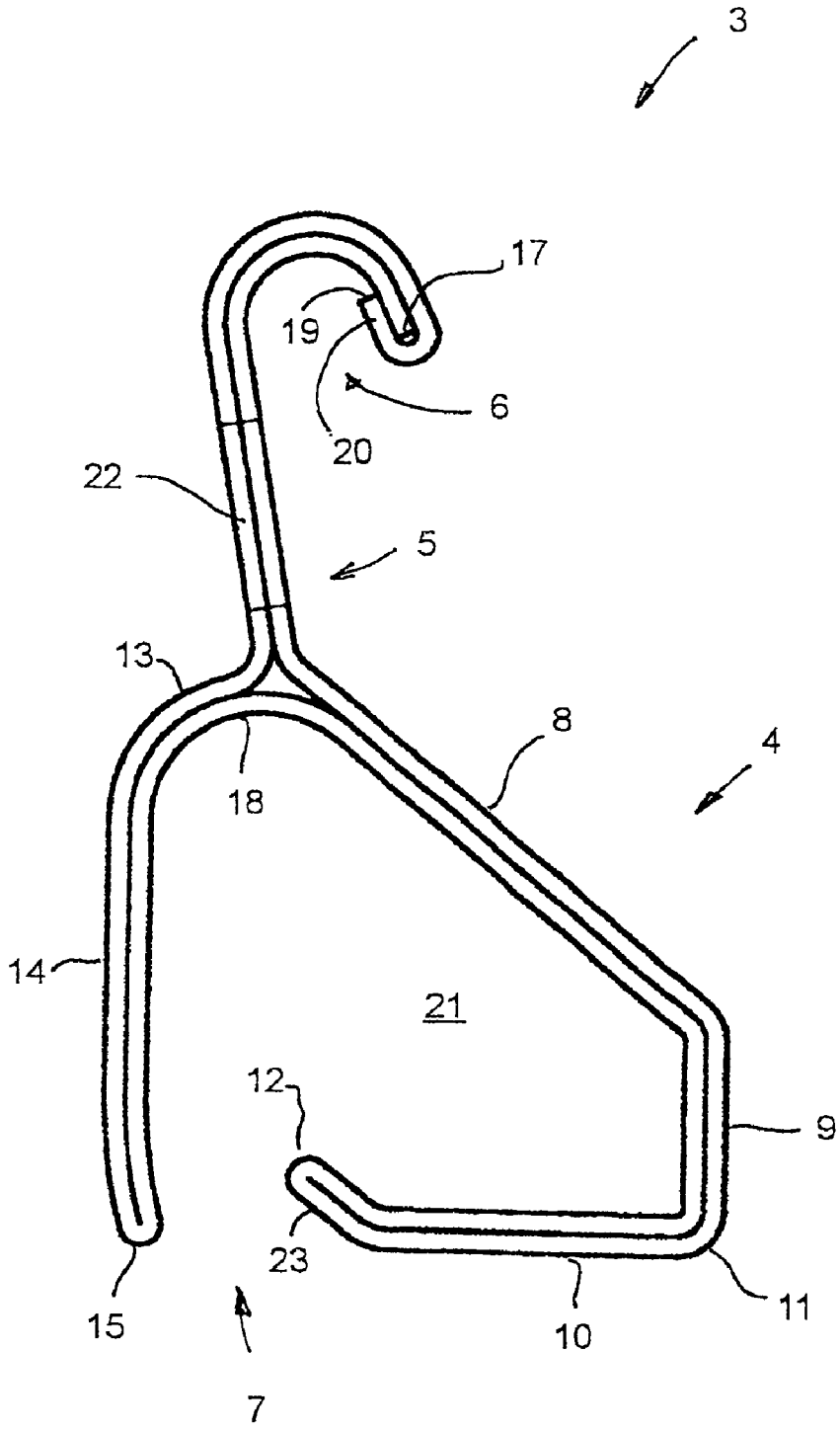
FIG. 2 is a front view of a first exemplary embodiment of a roller shutter lath according to the invention.

The cross sectional profile of each individual lath 3 is shown in FIG. 2. As shown in FIG. 2, the roller shutter lath 3 includes a base body 4 and a slat 5. The slat is formed at the upper edge of the base body and is curved into a downward opening channel 6 at its free end away from the base body 4. The lower side of the lath 3 contains an interengagement slot 7.

The base body 4 defines a front wall including first and second front wall segments 8 and 9. The first front wall segment 8 slopes downward at an angle of around 45° from the slat 5 in the state of use shown in FIG. 2. At its lower end, the first front wall segment 8 passes into the vertical second front wall segment 9 and is integral therewith. The lower free edge of the second front wall segment 9 is adjoined by a bottom side 10 that extends from a transitional edge 11 to a slot edge 12.

At the upper end, the front slanting first wall segment 8 merges with the slat 5, running at an angle of around 10° to the vertical. The upper free end of the slat 5 extends into the downward opening channel 6. The position of the channel 6 should be chosen such that its highest point in a usage position lies on a vertical line above the slot edge 12. The back side of the slat 5 is adjoined to a rear wall 14 via a bend piece 13 that extends roughly vertically when in a state of usage. The rear wall 14 terminates at an edge 15 that forms the other edge of the slot 7. Accordingly, the edge 15 is offset from the edge 12 in the horizontal direction. As also shown in FIG. 2, the illustrated roller shutter lath 3 has a two-ply construction with respect to its profile.

The roller shutter lath 3 is produced from an appropriately wide metal strip of a suitable material, such as coated aluminum sheeting or stainless steel (such as V2A or V4A steel) by a rolling process. One edge of the raw metal strip material, in this case the edge 17, lies at the free end of the channel 6. From that point, the formed material first follows the inner curvature of the channel 6 and then passes over to the outer layer of the slat 5. As a result of the forming process, in the lower region of the slat 5 the metal strip produces the outer layer of the slanting first front wall segment 8 and then passes into the outer layer of the vertical second front wall segment 9. Additionally, the metal strip adjoins the edge 11 in the outer layer of the bottom surface 10. From there it extends to the slot edge 12. At the slot edge 12, the material is bent over onto itself and extends as the inner layer of the bottom surface 10 up to the edge 11. Here, the material rises vertically upward and it lies closely against the outer layer of the second front wall segment 9. The sheet metal material then continues as the inner layer of the slanting first front wall segment 8, lying directly against its back or inner side, as far as the root of the slat 5. Here, the formed metal strip provides a partly cylindrical curved surface 18 as the inner layer of the bend piece 13. Adjoining this, the formed metal strip provides an interior layer of the rear wall 14, and thus up to the slot edge 15. Here, the metal strip is bent over onto itself by 180°, and from this point on it forms the outer layer of the rear wall 14. The metal strip follows the rear wall 14 until roughly the apex of the concavely curved surface 18 or the bend piece 13.

As shown in FIG. 2, after being formed the metal strip provides the layer of the slat 5 that lies toward the room or window side, as far as the channel 6. Here, the formed metal strip runs along the outer side of the channel 6 and finally, after the last forming process, it encloses the free lengthwise edge 17 of the metal strip in a U-shape. The other edge 19 of the metal strip lies inside the channel 6. This prevents any joint surfaces from being open to the outside. The joint surface is protected by the short wraparound 20 at the free end of the hook. With respect to the starting material, the two edges 17 and 19 are parallel to each other. The starting material is endless, as is usual with roller forming processes.

The roller bending forming process is carried out in such a way that, with the exception of a small triangular region at the root of the slat 5, two layers that lie close against each other without any gaps are produced in all locations. The two lengthwise edges 17 and 19 of the strip like starting material lie in close proximity to each other in the region of the channel 6 which forms a hook. As further shown relative to the connection of the roller shutter laths 3, the edges are thereby located in a protected region that helps prevent the possibility that the two layers might separate from each other at some place.

Due to the special configuration of the first and second front wall segments 8 and 9 in relation to the rear wall 14, the lath body 4 forms a relatively large, approximately triangular cavity 21 which, apart from the ends of the lath 3, is accessible only via the slot 7. The sheet metal does not have any free edge in the area of the slot edges 12 and 15. There, the material is turned over onto itself so as to provide good strength. The cavity 21 is free of slats or braces.

In order to allow light and air to pass when the roller shutter curtain 1 is hanging down, the illustrated slat 5 is provided with air or light slots 22. These slots 22 extend longitudinally. In particular, the slots 22 extend with their major axis parallel to the lengthwise dimension of the roller shutter lath 3 and have a vertical height limited to the area from the upper edge 13 to beneath the channel 6.

Figure 3:
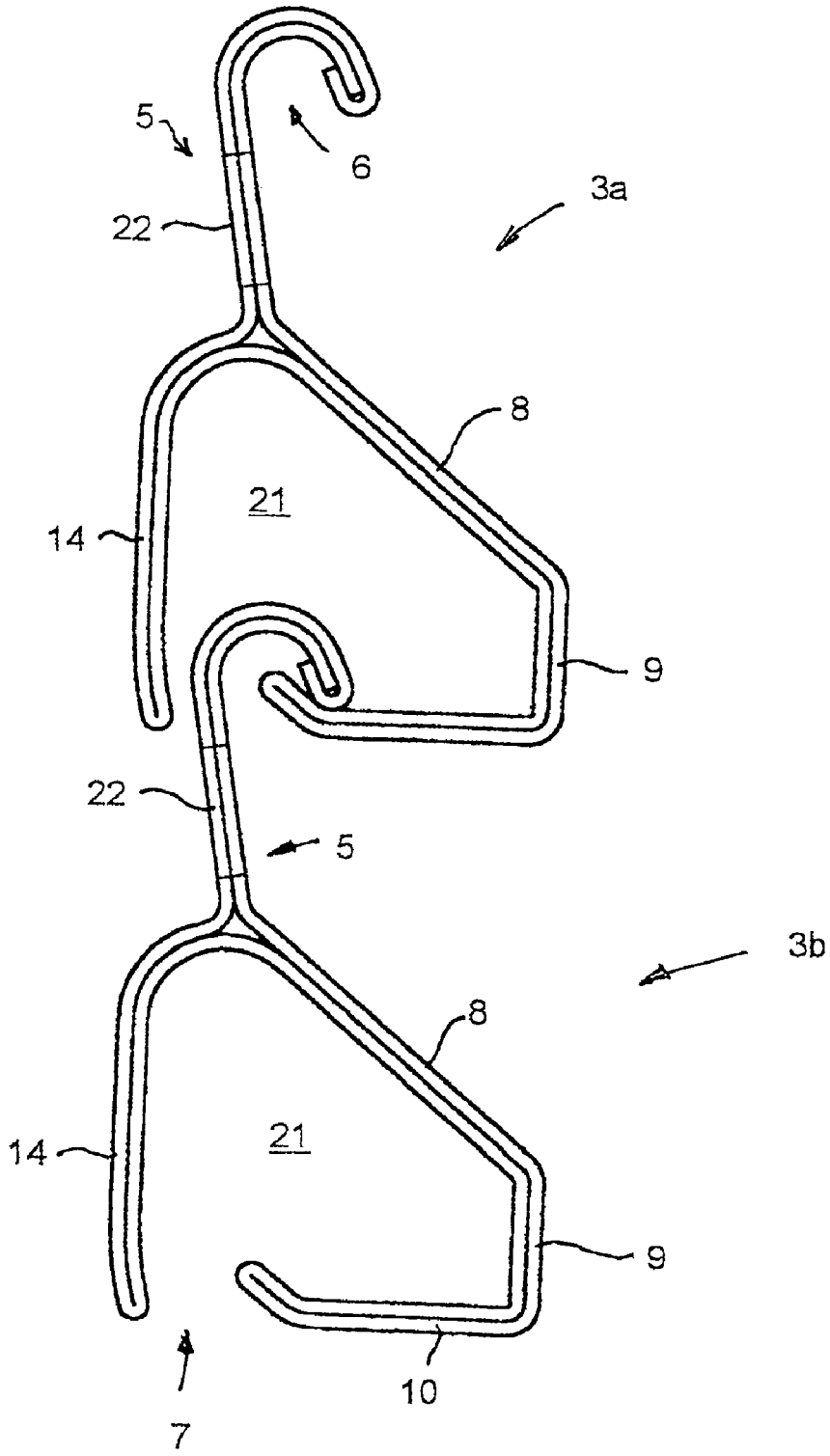
FIG. 3 is a front view of an assembly of two roller shutter laths according to FIG. 2.

FIG. 3 illustrates how two neighboring laths 3 are joined together. The lath 3*b* located beneath the lath 3*a* hangs with its channel-shaped profile segment 6 over the slot edge 12. So as to produce the most defined conditions possible, the illustrated lower wall 10 is bent upward at an angle of around 30° at a short distance from the slot edge 12. This produces a bend 23 which ensures that the back side of the slat 5 does not touch the slot edge 15 when the roller shutter curtain 1 is hanging down. This enables the roller shutter curtain 1 to be rolled up easily with the back wall 14 facing the axis of the shutter shaft 2.

The lower wall 10 extends horizontally or, starting at the slot 7, slightly downward slanting manner to the edge 11 in order to serve as a drip edge when used outdoors that keeps water draining from the slanting first front wall segment 8 away from the slots 22. The slanting first front wall segment 8 ensures that the lath 3 increases in volume in the thickness direction while preventing dirt deposits. Furthermore, incident light is reflected so that glare cannot get through the light slot 22 by virtue of multiple reflections at the lower wall 10.

The width of the slot 7 is dimensioned so that the lath 3*b* suspended therein can swivel sufficiently about an axis (that is perpendicular to the plane of FIG. 2) relative to the lath 3*a* situated above it.

The height of the slat 5 up to the lower edge of the channel 6 is around 30% to 60% of the height of the lath body 4. The height of the light/air slot 22 is around 40% to 80% of the height of the slat 5. When hanging down, the surface component of the light/air slots 22 is around 20% to 30% of the overall surface of the roller shutter curtain 1. Due to this relatively large proportion, a large amount of diffuse, scattered light can get in via the light/air slots when the roller shutter curtain 1 is completely deployed and spread out in front of a window. On the other hand, the lower side 10 projecting out from the light/air slot acts as an awning or sun canopy casting a shadow on the light/air slot and prevents direct solar radiation from getting through the light/air slot. Depending on the relation between the height of the light/air slot 22 and the amount of projection, this shadowing effect occurs as the sun moves through the sky down to around 22° above the horizon.

The light/air slots 22 uniformly divide the window surface into light-transmitting strips, each strip having its own awning casting its own shadow. This reduces the size of the projection of the sun canopy as compared to an arrangement in which the light slots are joined to each other. Such an arrangement would require an "awning" that projects far out to cast the same shadow with the same angle of incidence.

With an arrangement according to the present invention, the roller shutter curtain 1 can be used on the inside of the window, since its overall thickness measured in the direction perpendicular to the window surface is around 8-15 mm. Moreover, a roller-type lath according to the invention allows roller shutter curtains 1 to be constructed which prevent direct solar radiation in the summer and thus reduce room heating, while still allowing sufficient daylight to reach the room.

The high proportion of transparent surface due to the large slots also significantly improves the subjective perception of transparency. A person in the room can see out better through a roller shutter curtain made from laths according to the present invention. There is no feeling of being "closed in." A roller shutter lath of the present invention does not prevent visual contact with the outside world, as is the case with known roller shutter laths.

If the roller shutter curtain 1 is placed on the window sill and the roller shutter curtain 1 collapses on itself, the slat 4 at each roller shutter lath 3 disappears entirely in the lath body 4 so as to achieve a total darkening even for diffuse light.

A roller shutter curtain 1 made from the laths of FIG. 2 or FIG. 3 across the front wall segment 9 can be easily rolled up. Moreover, the roller shutter curtain could be wound up in the opposite direction, i.e. wherein the front side faces the winding shaft.

Figure 4:
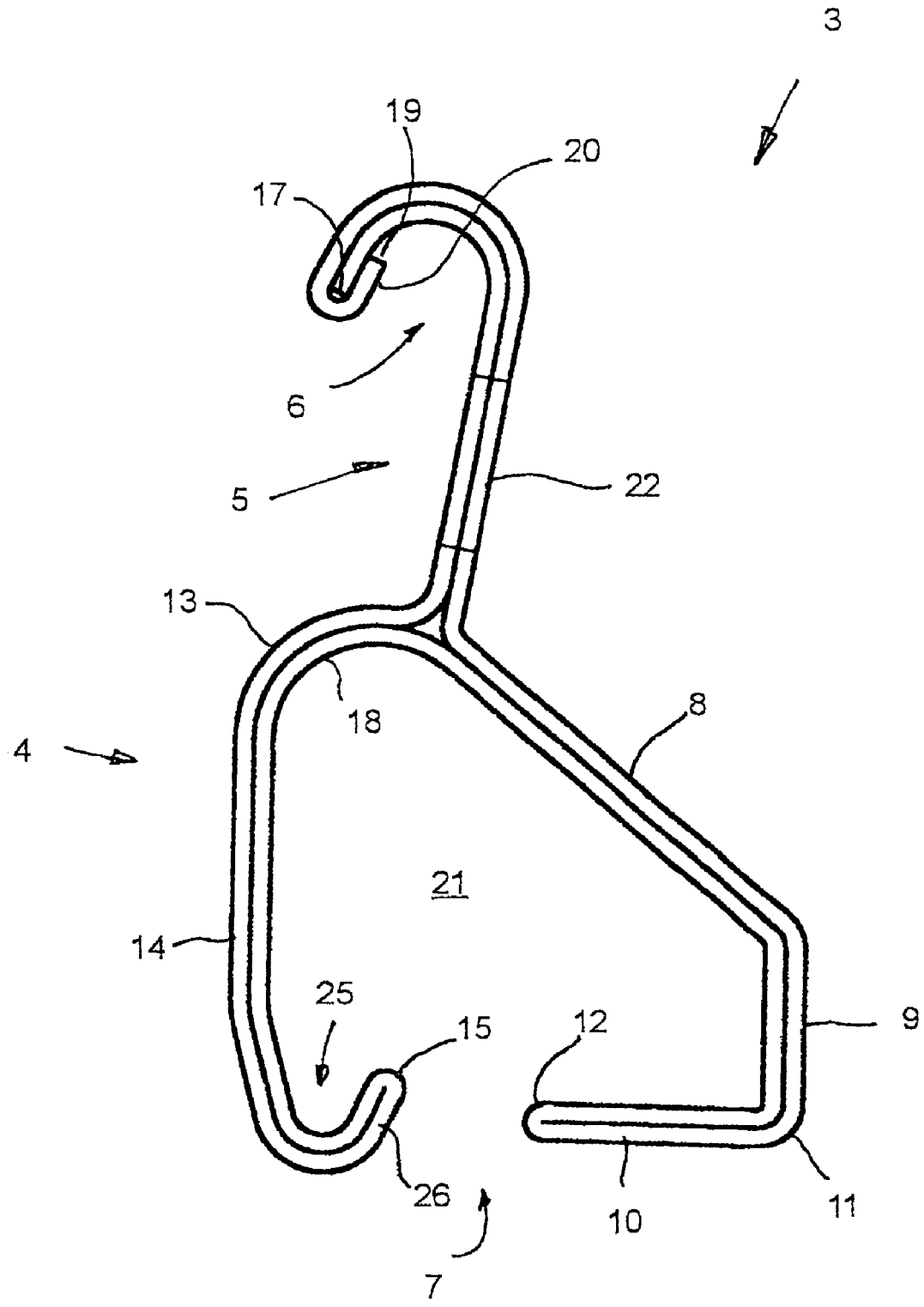
FIG. 4 is a side view of a second exemplary embodiment of a lath according to the present invention that has been fabricated as a rolled and formed part.

In the embodiment of FIG. 2, the channel 6 that serves as a hook and thus a form-fitting connection mechanism points downward with a component away from the front side of the roller shutter lath 3. The embodiment of FIG. 4 illustrates that is possible to reverse the orientation of the channel 6 that serves as a hook. In the embodiment of FIG. 4, the channel 6 again opens downward, but with a component away from a surface that is defined by the rear wall 14.

In order to hook together the roller shutter laths 3 in the vertical direction of the roller shutter curtain 1, the profile is slightly modified in the vicinity of the rear slot edge 15 in the embodiment of FIG. 4. The double-ply rear wall 14 passes into an upwardly open channel 25 at its lower end, so that the slot edge 15 is situated at the free edge of an upwardly pointing bend 26. The slot edge 12 lies directly at the end of the lower wall 10, which in this case is not bent upward. The roller shutter lath 3 located underneath hangs by its channel 6 over the slot edge 15.

Figure 5:
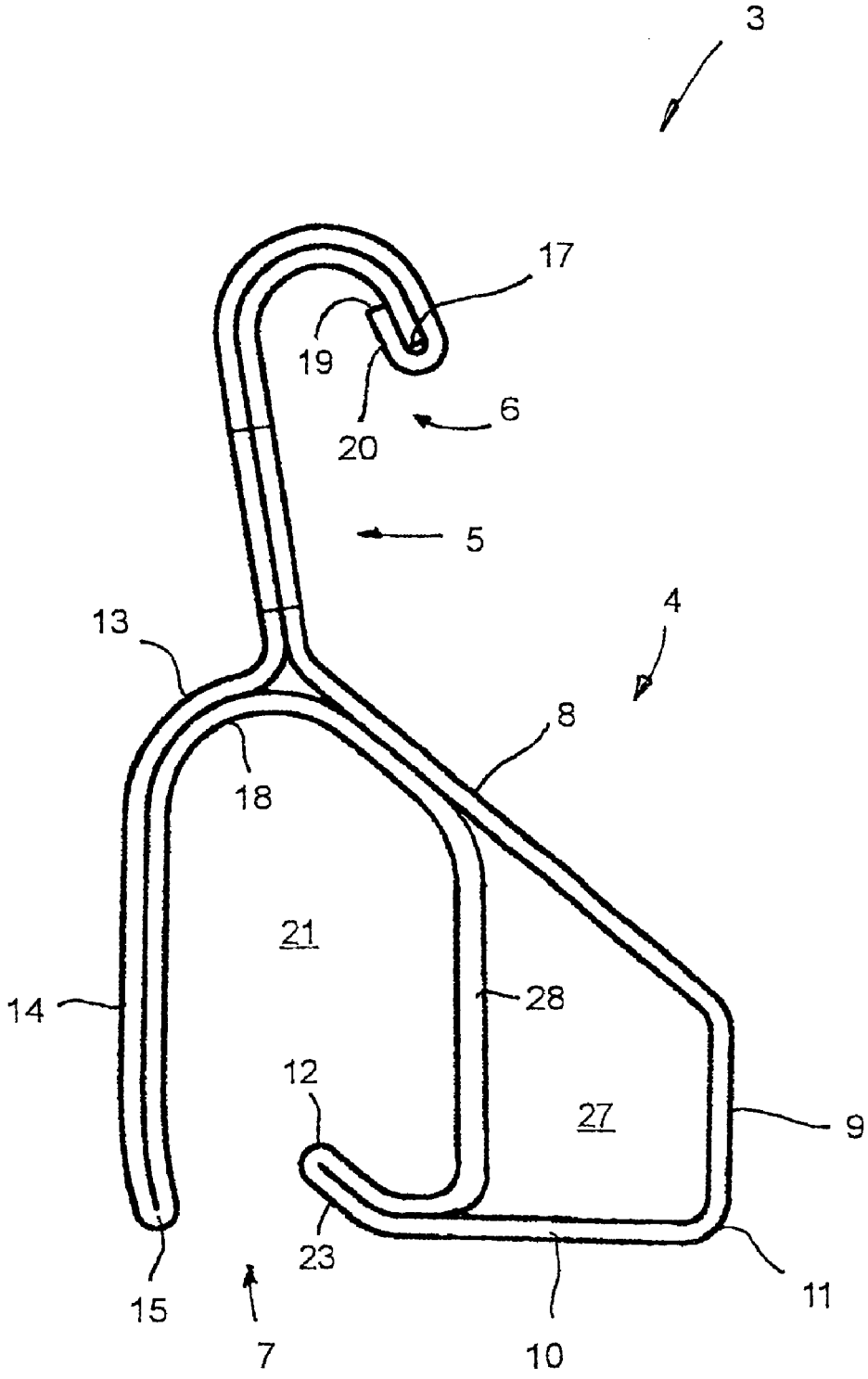
FIG. 5 is a side view of a third exemplary embodiment of a roller shutter lath according to the present invention that has been fabricated as a rolled and formed part.

In the embodiments of FIGS. 2 and 4, the layers of the starting material lie closely against each other in all possible locations. An embodiment in which an additional chamber 27 is formed in the area of the slanting first front wall segment 8 and the vertical second front wall segment 9 is shown in FIG. 5. In this area, one segment 28 of the inner layer is displaced in the direction of the rear wall 14. This produces a closed chamber 27. This chamber 27 can be packed with hard foam from the side. The cavity 27 has a right trapezoidal cross-sectional shape.

A roller shutter lath is provided that consists of a profile that is formed from a flat metal strip by a rolling process. The roller shutter lath comprises, as a single piece, a shutter body with a slot contained at the bottom side and a hooked slat provided at the top edge. The proportion of slots in the overall surface of the roller shutter lath is around 20%.

The invention claimed is:

1. A roller shutter (1) comprising:

a plurality of roller shutter laths (3) each made from a rolled and formed one piece sheet material;

said laths (3) each comprising a slat (5) extending the length of the roller shutter lath (3), said slat (5) being curved at a lengthwise edge thereof to form a channel (6) and a hook arrangement;

a plurality of light/air slots (22) arranged in the slat (5), said light/air slots (22) being arranged adjacent each other in the lengthwise direction of the roller shutter lath (3), said light/air slots (22) having a height corresponding to 40% to 80% of the height of the slat (5) such that in the suspended state of the roller shutter (1) the proportion of surface area of the light/air slots (22) amounts to about 20% to 30% of the total surface area of the roller shutter (1);

a lath body (4) having a top side (13) from which the slat (5) emerges and extends, said channel (6) being arranged a distance from the lath body (4) such that the height of the slat (5) measured between the channel (6) and the top side of the lath body (4) is more than 30% of the height of the lath body (4);

said lath body (4) having an underside (10) and defining an interengagement slot (7) extending along the length of the lath (3), said interengagement slot (7) opening downwardly away from the slat (5) and being configured such that the channel (6) of a second identically configured roller shutter lath (3) can be hooked therein; and a canopy-like projection (10) formed by said underside (10) between the interengagement slot (7) and a front side (8,9) of the lath (3) that extends along the length of the roller shutter lath (3) alongside the slot (7) and forms a sunroof protruding forwardly of the light/air slots (22) in the lath (3) located underneath which shades the light/air slots (22) of an underlying lath (3).

2. A roller shutter according to claim 1, wherein the canopy-like projection is arranged at a bottom side of a hollow space defined by the lath body.

3. A roller shutter according to claim 1, wherein the canopy-like projection is formed by a bottom side of the lath body in the area between the interengagement slot and a front side of the roller shutter lath.

4. A roller shutter according to claim 1, wherein the slat has a two-ply construction.

5. A roller shutter according to claim 1, wherein the roller shutter lath has a two-ply construction in the area of the channel.

6. A roller shutter according to claim 5, wherein an outer layer of the two-ply construction is bent inward at a free edge thereof in the area of the channel.

7. A roller shutter according to claim 1, wherein the lath body has a plurality of sides and each side has a two-ply construction.

8. A roller shutter according to claim 7, wherein the interengagement slot is bounded by two edges that are parallel to each other, one of the edges being spaced upwards from the other in a direction towards an interior of the lath body.

9. A roller shutter according to claim 8, wherein the two-ply construction comprises two sheet metal layers and the two sheet metal layers are co-joined at the edges of the interengagement slot.

10. A roller shutter according to claim 9, wherein the two sheet metal layers are adjacent each other in all locations except a at a base of the slot.

11. A roller shutter according to claim 1, wherein the lath body defines a continuous cavity.

12. A roller shutter according to claim 1, wherein the lath body defines a front side including a first slanting surface and a second surface that extends vertically from the front slanting surface.

13. A roller shutter according to claim 1, wherein the lath body defines a rear side that extends vertically.

14. A roller shutter according to claim 1, wherein the slat has a predetermined height that prevents the light/air slats in the slat from being covered by an upper identically configured roller shutter lath when the roller shutter lath is suspended from the upper roller shutter lath.

15. A roller shutter according to claim 1, wherein the lath body includes a bottom side having a flat surface lying next to the interengagement slot.

16. A roller shutter according to claim 15, wherein the bottom side of the lath body extends horizontally in the direction of a front wall of the lath body.

17. A roller shutter according to claim 1, wherein the roller shutter lath is made of an aluminum or coated aluminum material.

* * * * *